US005795145A

United States Patent [19]

Manning et al.

[11] Patent Number: 5,795,145

[45] Date of Patent: Aug. 18, 1998

[54] METHOD AND APPARATUS FOR CONTROLLING GAS FLOW TO CERAMIC PLAQUE BURNERS OF DIFFERING SIZES

[75] Inventors: John S. Manning; Christopher P. Hollis; James L. Jacobs; Ralph E. Pratt, all of Bowling Green, Ky.

[73] Assignee: DESA International, Bowling Green, Ky.

[21] Appl. No.: 861,950

[22] Filed: May 22, 1997

[51] Int. Cl.[6] ..... F23Q 9/08

[52] U.S. Cl. ..... 431/280

[58] Field of Search ..... 431/280

[56] References Cited

U.S. PATENT DOCUMENTS 5,470,018 11/1995 Smith ..... 431/280

*Primary Examiner*—Carroll B. Dority

*Attorney, Agent, or Firm*—Jones, Day, Reavis & Pogue

[57] ABSTRACT

A radiant gas heater includes a first ceramic plaque burner and an adjacent and larger second plaque burner. A valve spindle is movable to establish in series "Low," "Medium" and "High" heat positions by first supplying gas in the vicinity of the first burner, then supplying gas in the vicinity of the second burner while momentarily maintaining the flow of gas to the first burner, next discontinuing the flow of gas to the first burner and finally by reestablishing the flow of gas to the first burner while maintaining the flow of gas to the second burner.

8 Claims, 4 Drawing Sheets

(a)
LOW
(b)
MEDIUM
(c)
HIGH (a)
MEDIUM
(b)
HIGH
(c)
LOW 10
12
(a)
LOW
10
12
(b)
MEDIUM
10
12
(c)
HIGH

METHOD AND APPARATUS FOR CONTROLLING GAS FLOW TO CERAMIC PLAQUE BURNERS OF DIFFERING SIZES

BACKGROUND OF THE INVENTION

Radiant gas heaters with inputs greater than about 10,000 BTU/hour typically use multiple burners having ceramic plaques mounted adjacent to one another in a horizontal fashion within a cabinet. The combustion of the gas and air mixture occurs very near the outer surface of the plaque, which produces radiant heat off of a glowing surface. The user of such a heater may select a heat setting by manually turning a control knob of a gas valve to "Low", "Medium", or "High" heat settings in series which is a logical operating sequence.

For example, individual burners may produce about 6,000 BTU/hour each. An 18,000 BTU/hour heater would have three individual burners. The operating sequence of such a heater would be 6,000 BTU/hour or one burner on "Low"; 12,000 BTU/hour or two burners on "Medium"; 18,000 BTU/hour or three burners on "High". FIGS. 1(*a*)–1(*c*) depict this operation.

The first burner turned "on" at the "Low" setting would be ignited by a pilot. Subsequent burners turned "on" at the "Medium" or "High" settings would be ignited by the adjacent burner. In the previous example, the "Low" setting would correspond to the middle burner; the pilot would be mounted approximately at the lowest plane of this burner. "Medium" and "High" settings would correspond to the left and/or right burners; they would be ignited by the center burner.

The manually operated control valves typically provide distinct notches for engaging the valve in the "Low", "Medium", and "High" settings. Consequently, the user employs a combination of press and turn motions of the control knob to select another heat setting. The rotational movement between settings range from about 40 to 60 degrees; thus, a short but discrete length of time is involved in changing from one setting to another.

Some radiant gas heaters replace two of the individual burners with one larger burner. The primary benefit of such a design is simplification for cost reduction. However, the operating sequence for existing heaters having this burner configuration is less desirable for a user because it is illogical. Using a similar example as before, an 18,000 BTU/hour heater would have two individual burners: one large at 12,000 BTU/hour and one small at 6,000 BTU/hour. The user may select a heat setting by manually turning a control knob of a gas valve, but in this design the operating sequence would be 12,000 BTU/hour or the large burner on "Medium"; 18,000 BTU/hour or both burners on "High"; 6,000 BTU/hour or the small burner on "Low". FIGS. 2(*a*)–2(*c*) depict this operation.

The large burner turned "on" at the first (Medium) setting would be ignited by the pilot. In the second (High) setting, the adjacent small burner would be ignited by the large burner that remains "on". Lastly, the third (Low) setting would result in the large burner turning "off" and the small burner remaining "on". This operating sequence is necessary in order to insure safe ignition characteristics when using current gas valves.

The problem in going from "Low" to "Medium" rather than from "Off" to "Medium" in a heater of the type just described is that if the control knob of the gas valve is rotated slowly, a momentary lapse in supplying gas to an individual burner may occur. Delayed ignition—an undesirable and potentially unsafe condition—may occur when changing the setting from "Low" to "Medium". The "Low" setting would correspond to the small burner being "on"; the "Medium" setting would correspond to the large burner being "on" and the small burner being "off". Delayed ignition may occur if the flame at the small ("Low") burner is extinguished before ignition occurs at the large ("Medium") burner. Thus, the design and construction of current gas valves, specifically relating to the geometry of the interrelated parts that direct the gas flow from the single inlet to the multiple outlets, force the operating sequence for safe operation to be from "Medium" to "High" to "Low", as shown in FIGS. 2(*a*)–2(*c*), thereby resulting in positive ignition characteristics.

SUMMARY OF THE INVENTION

The present invention resides in a configuration of a gas valve for controlling gas flow to ceramic plaque burners of differing sizes in order to achieve progressively higher inputs with safe ignition characteristics in a gas heater. Using the same example as before, an 18,000 BTU/hour heater would have two individual burners: one large at 12,000 BTU/hour and one small at 6,000 BTU/hour. The user may select a heat setting by manually turning a control knob of a gas valve. The operating sequence would be 6,000 BTU/hour or the small burner on "Low"; 12,000 BTU/hour or the large burner on "Medium"; 18,000 BTU/hour or both burners on "High". FIGS. 3(*a*)–3(*c*) depict this operation.

Such a heater design has two distinct advantages. First, the use of one large burner to replace two small burners results in simplification for cost reduction. Second, the operating sequence of "Low" to "Medium" to "High" is logical for users which simplifies operation.

The invention eliminates the delayed ignition when changing the heat input setting. The design and construction of the valve of the present invention, specifically related to the geometry of the interrelated parts that direct the gas flow from the single inlet to the multiple outlets, allow a logical operating sequence with safe operation. Within the valve housing is a truncated cone spindle that is turned by a control knob. The spindle has both a slot and holes for directing the gas flow into the appropriate outlets on the valve housing. The invention resides in the geometric relationship between these spindle features and the valve housing outlets and the method of operating the valve. When the control knob—and concurrently the spindle—is rotated from "Low" to "Medium", the gas flow continues momentarily to the small burner (Low) as it is redirected to the large burner (Medium). This lag in shutting off the gas flow to the small burner allows ignition to be established on the large burner from the small burner before the small burner is turned completely "off".

DESCRIPTION OF A PREFERRED EMBODIMENT

Figure 8:
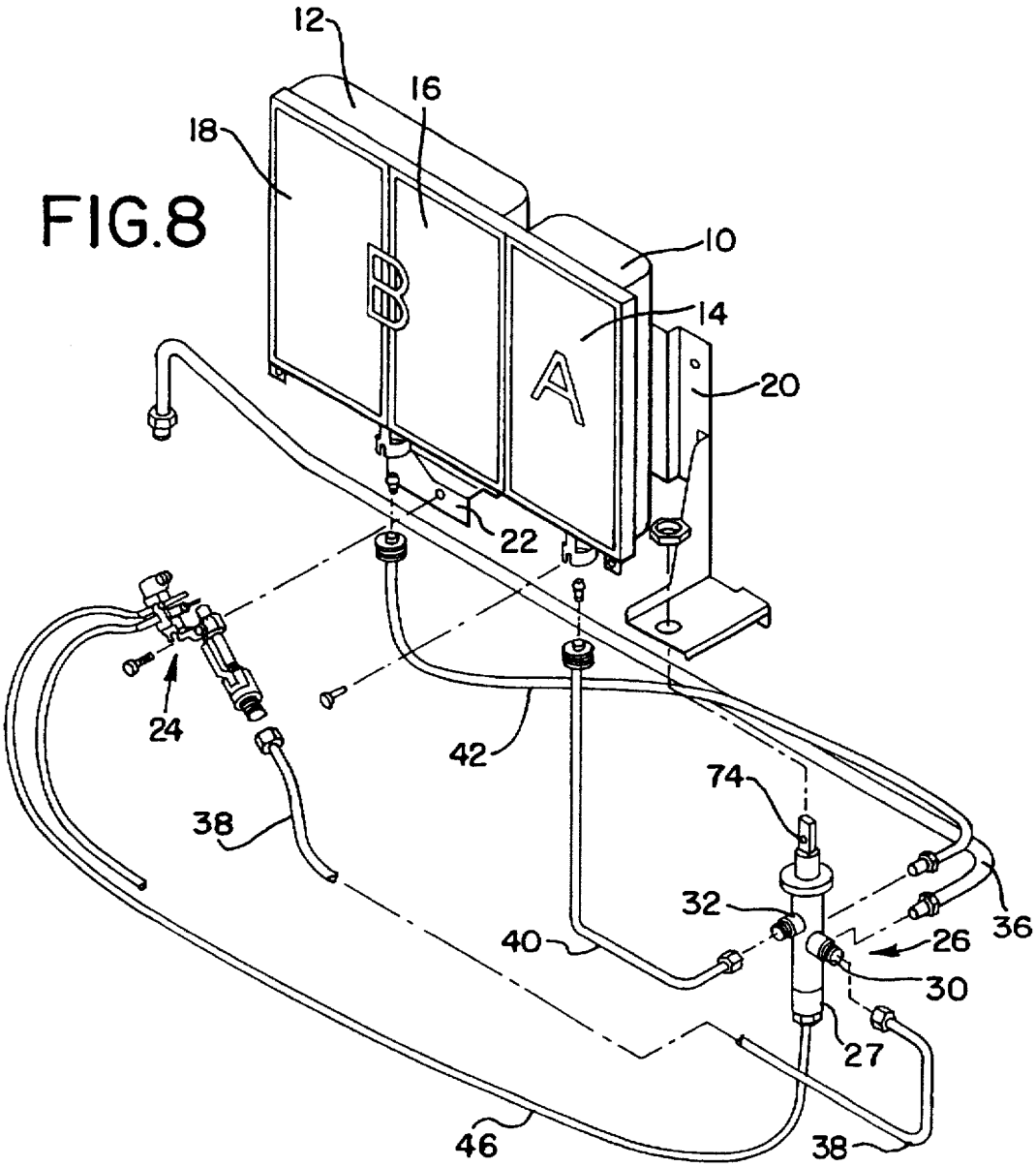
FIG. 8 is a fragmentary, exploded isometric view of a two-plaque burner embodying the present invention.
Figure 9A:
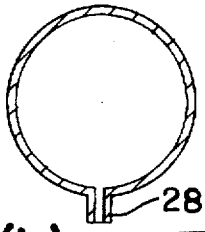
FIGS. 9(*a*)–9(*f*) are sequential schematic views taken along line 9—9 of FIG. 5.
Figure 10A:
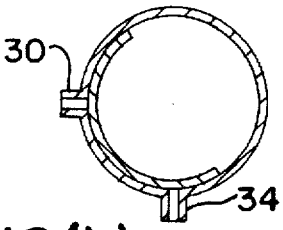
FIGS. 10(*a*)–10(*f*) are sequential schematic views taken along line 10—10 of FIG. 5.
Figure 11A:
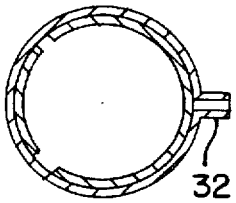
FIGS. 11(*a*)–11(*f*) are sequential schematic views taken along line 11—11 of FIG. 5.
Figure 9B:
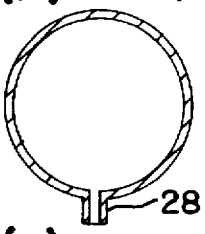
Figure 10B:
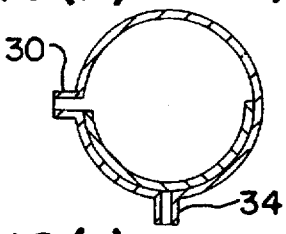
Figure 11B:
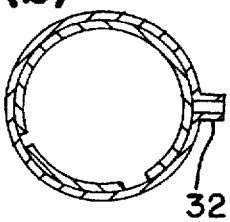
Figure 9C:
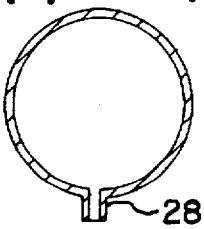
Figure 10C:
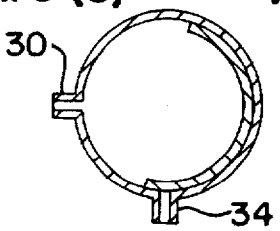
Figure 11C:
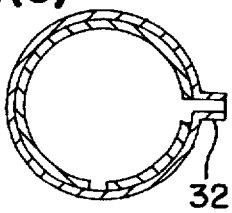
Figure 9D:
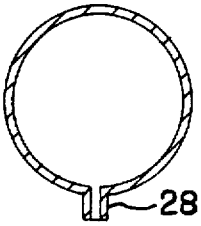
Figure 10D:
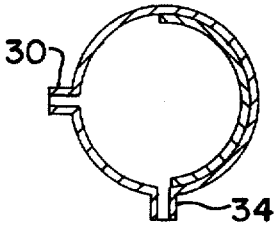
Figure 11D:
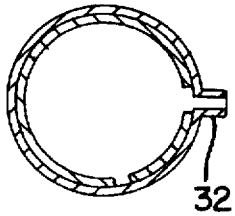
Figure 9E:
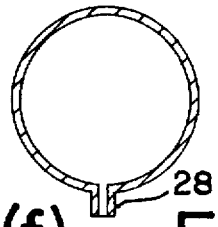
Figure 10E:
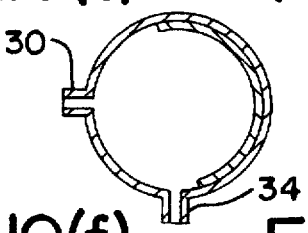
Figure 11E:
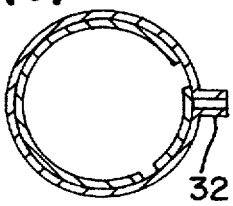
Figure 9F:
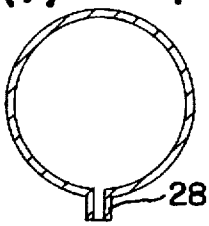
Figure 10F:
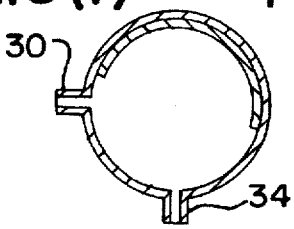
Figure 11F:
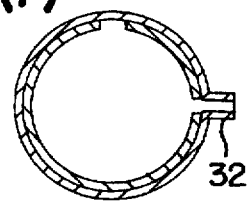

Referring first to FIG. 8, a heater embodying the present invention includes a first burner 10 and a larger burner 12. In the embodiment shown for purposes of illustration, but not by way of limitation, the small burner is in the form of a plaque burner having a rectangular ceramic plaque 14. In the embodiment shown for purposes of illustration, the larger burner 12 includes two ceramic plaques 16 and 18. However, the larger burner may be formed as a single ceramic plaque. A suitable bracket mounts the plaques in substantial co-planar relationship. For example, in the preferred embodiment, the burner 10 has a rating of 6,000 BTU/hour; the larger burner 12 has a rating of 12,000 BTU/hour.

The burner 12 includes a bracket 22 for mounting a pilot light assembly 24; this pilot light assembly is of conventional construction and includes an oxygen depletion sensor. The bracket 22 mounts the pilot light assembly 24 such that the pilot flame will be directed toward the small burner 10.

Referring now to FIGS. 4–6 and 8, the present invention includes a valve, generally designated 26. This valve includes a generally cylindrical housing 27 having an inlet passageway 28. The valve housing 27 includes outlet passageways 30, 32 and 34.

The inlet passageway 28 is in communication with one end of an inlet tube 36 (FIG. 8). It will be understood that the other end of the tube 36 is in communication with a suitable source of gas, such as propane or natural gas. The passageway 30 is in communication with one end of a tube 38; the other end of this tube is in communication with the pilot light assembly 24. Outlet passageway 32 is in communication with one end of a tube 40; the other end of this tube communicates with the face of the ceramic plaque 14 of the small burner. Outlet passageway 34 is in communication with one end of a tube 42; the other end of this tube communicates with the faces of the plaques 16 and 18 of the larger burner 12. Valve 26 is also in communication with a thermocouple lead 46 which is in communication with the pilot light assembly. As is known to those skilled in the art, if the oxygen depletion sensor forming part of the pilot light assembly detects a predetermined minimum amount of oxygen in the vicinity of the burners, the thermocouple will be activated for turning off the flow of gas to the burners.

Figures 1, 2, 3:
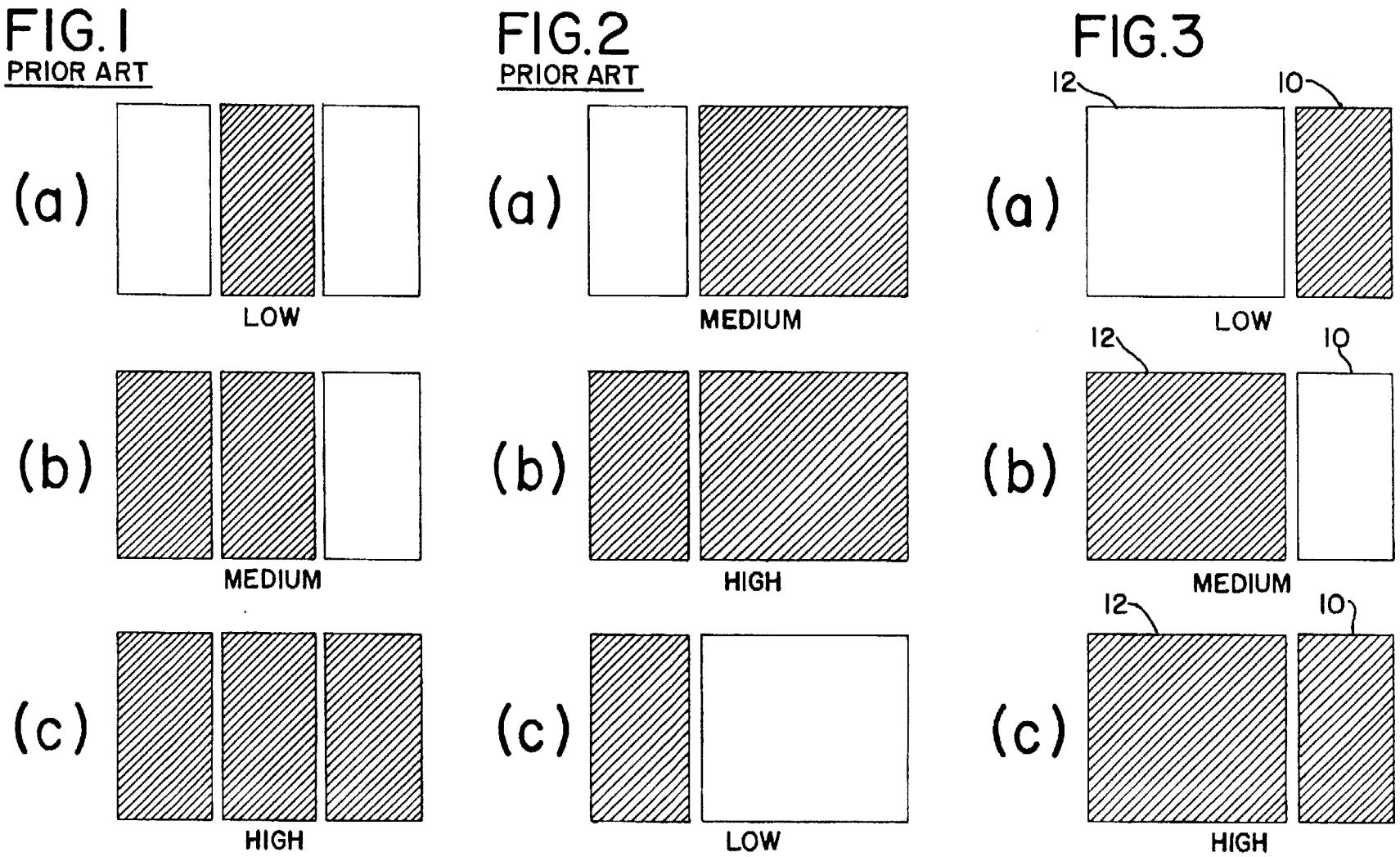
FIG.1 PRIOR ART
FIG.2 PRIOR ART
FIGS. 1(*a*)–1(*c*) are schematic drawings showing the operating sequence of a prior art three-plaque burner.
FIGS. 2(*a*)–2(*c*) are schematic drawings showing the operating sequence of a prior art two-plaque burner.
FIGS. 3(*a*)–3(*c*) are schematic drawings showing the operating sequence of a two-plaque burner embodying the present invention.
Figure 4:
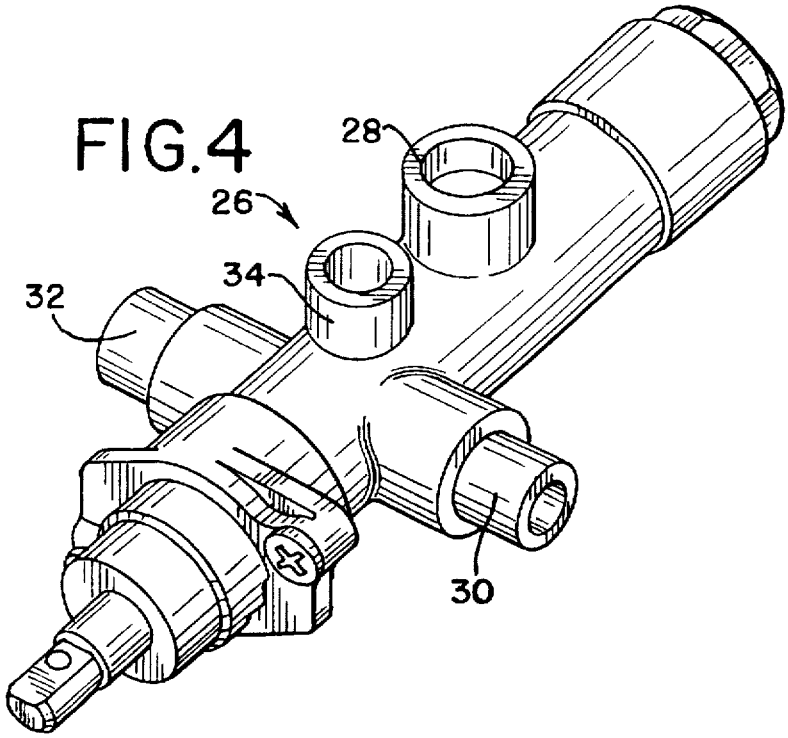
FIG. 4 is an isometric view of a valve in accordance with the present invention.
Figure 5:
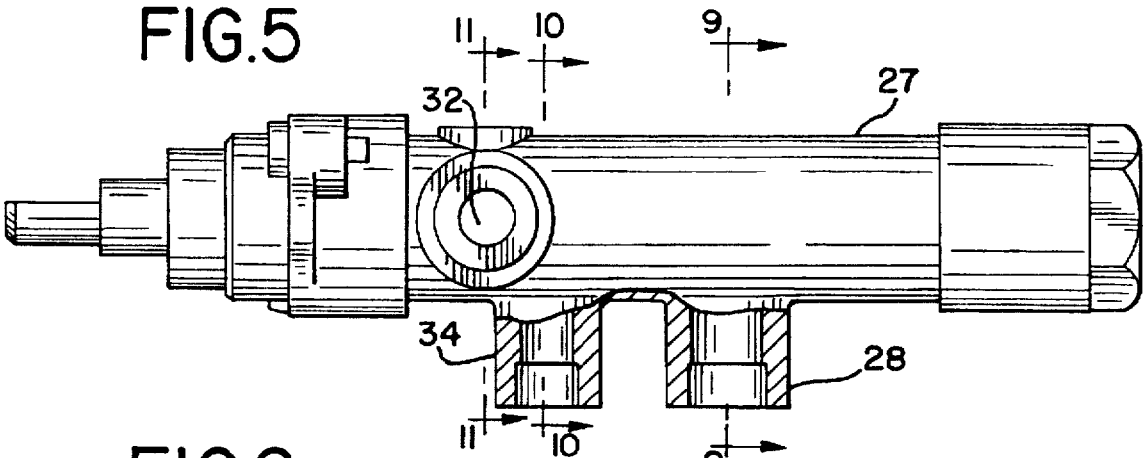
FIG. 5 is a side view of the valve of FIG. 4 with its longitudinal axis in a horizontal plane and with the valve rotated 180° from the position shown in FIG. 4.
Figure 6:
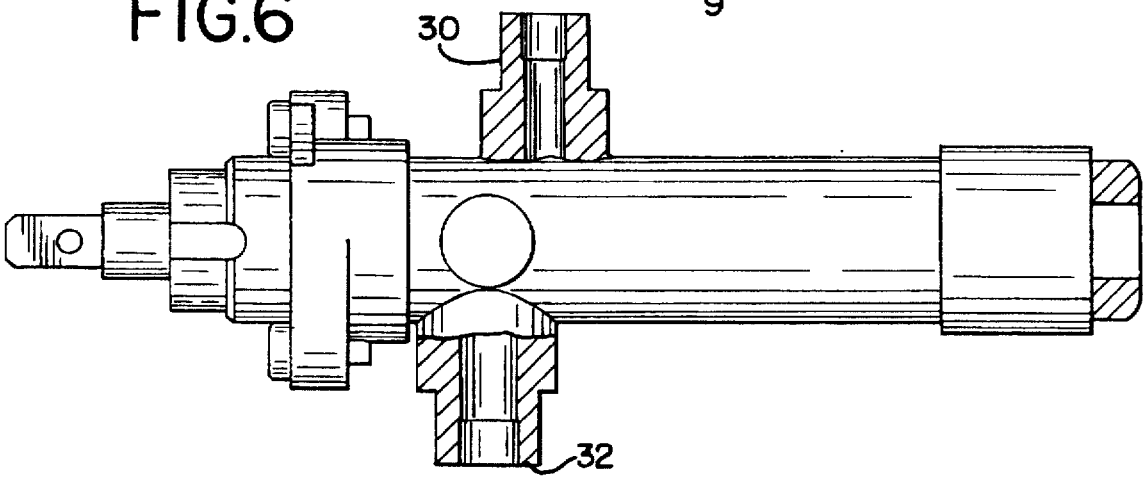
FIG. 6 is a top plan view of the valve as shown in FIG. 5.
Figure 7:
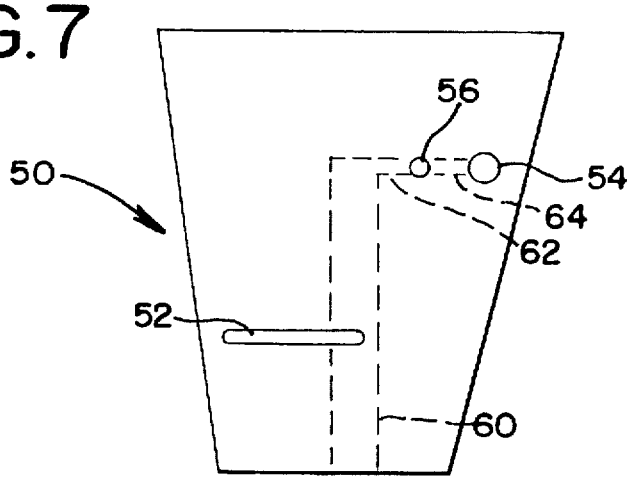
FIG. 7 is a diagramatic view of the spindle of the valve.

The valve housing 27 mounts a frustoconical valve spindle designated 50 in FIG. 7. FIG. 7 illustrates a two-dimensional view of the valve spindle. The valve spindle 50 includes an arcuate slot 52 formed in the exterior surface of the spindle. This arcuate slot is contained in a plane perpendicular to the longitudinal central axis of the valve 26, i.e., the axis of rotation of the valve spindle 50. The slot 52 extends through an arc of approximately 180°.

The valve spindle also includes a radial bore 54 which opens to the exterior surface of the valve spindle. The valve spindle further includes a second radial bore 56 opening to the exterior surface of the valve spindle. It will be understood that the bores 54 and 56 are co-planar and are contained in a plane which is perpendicular to the axis of rotation of the valve spindle 50. As noted in FIG. 7, the diameter of the bore 54 is larger than the diameter of the bore 56.

The valve spindle 50 includes a first internal, central, axial passageway 60 which communicates the inlet passageway 28 with the arcuate slot 52. The spindle 50 further includes internal passageways 62 and 64 communicating the inlet passageway 28 with the bores 54 and 56. In actual practice, the passageways 60, 62 and 64 are coaxial with each other and with the longitudinal central axis of the valve spindle.

The spindle 70 includes an extension 74 (FIG. 8) which extends exteriorly of the valve housing 27. This extension is connected to a rod and operating knob (not shown) for rotating the valve spindle in sequence between "Off", "Pilot", "Low", "Medium" and "High" positions. When the valve spindle is in the "Off" position, the spindle passageway 60 is in communication with the valve housing passageway 28, which passageway extends to the source of gas. Passageway 60 in the spindle remains in communication with the passageway 28 through all of the positions of the valve spindle.

The arcuate slot 52 in the valve spindle is arranged for communication with the valve housing passageways 30 and 34. The bores 54 and 56 in the valve spindle are arranged for communication with the valve housing passageway 32.

The operation of the valve can be best understood with reference to FIGS. 9(*a*)–9(*f*), 10(*a*)–10(*f*) and 11(*a*)–11(*f*). The darkened areas in these schematic views indicate the flow of gas.

Referring to FIGS. 9(*a*), 10(*a*) and 11(*a*), the valve spindle 50 is shown in the "Off" position; gas is admitted to the arcuate slot 52 and to the bores through the valve housing passageway 28 and spindle passageways 60, 62 and 64. There is no flow to the pilot light assembly 24 or to the burners 10 and 12. Neither the slot 52 nor the bores 54 and 56 communicate with the outlet passageways 30, 32 and 34.

Referring to FIGS. 9(*b*), 10(*b*) and 11(*b*), the valve spindle is shown in its "Pilot" position. In this position, the arcuate slot 52 is brought into communication with the passageway 30 which extends to the pilot light assembly. Thus the pilot light may be ignited by a suitable igniter (not shown). There is no flow to either of the burners because neither the slot 52 nor the bores 54, 56 communicate with the valve housing passageways 32 and 34.

FIGS. 9(*c*), 10(*c*) and 11(*c*) show the valve spindle in its "Low" position. In this position, the bore 54 is brought into communication with the valve housing passageway 32 thus permitting the flow of gas to the smaller burner 10. In the "Low" position, there is no flow to the large burner 12 because the arcuate slot 52 is not in communication with the valve housing passageway 34.

FIGS. 9(*d*), 10(*d*) and 11(*d*) show the valve spindle 50 in an intermediate position between its "Low" and "Medium" positions. Looking to FIG. 10(*d*), we see that the arcuate slot 52 has been brought into communication with the valve housing passageway 34 thus permitting the flow of gas to the larger burner 12. As seen in FIG. 11(*d*), gas continues to flow from the bore 54 to the passageway 32 extending to the smaller burner 10. This feature, resulting from the larger diameter bore 54, ensures that the gas being admitted to the larger burner plaques 16 and 18 will be ignited by flame on the front surface of the plaque 14 of the smaller burner.

Referring now to FIGS. 9(*e*), 10(*e*) and 11(*e*), the spindle 50 has been rotated to the "Medium" position. The slot 52 remains in communication with the valve housing passageway 34, thus continuing the flow of gas to the larger burner 12. However, there is no longer a flow to the small burner 10 because the bore 54 is no longer in communication with the valve housing passageway 32.

FIGS. 9(*f*), 10(*f*) and 11(*f*) illustrate the valve spindle in its "High" position. The arcuate slot 52 remains in communication with the valve housing passageway 34 for continuing the flow of gas to the larger burner 12. The smaller-in-diameter bore 56 is brought into communication with the valve housing passageway 32 for admitting gas to the smaller burner 10. Smaller burner 10 will be ignited both by the pilot flame and the flame adjacent the face of the larger burner 12.

Accordingly, it is seen that the present invention provides an apparatus and method for utilizing two burners of different sizes and for igniting such burners to provide, in sequence, "Low", "Medium" and "High" heat settings. It will be understood that the foregoing description relates to a preferred embodiment of the invention by way of example only.

Many variations of the invention will be apparent to those skilled in the art and such variations are within the scope of the invention as set forth in the following claims.

We claim:

1. An apparatus for controlling ignition of a first plaque burner and a larger second plaque burner mounted in substantial coplanar adjoining relationship with the first plaque burner to achieve "Low", "Medium" and "High" heat settings in series, said apparatus comprising:

(a) a first plaque burner and a second larger plaque burner mounted in substantial coplanar adjoining relationship with the first plaque burner;

(b) a pilot light assembly mounted in the vicinity of the first plaque burner;

(c) a valve housing having an inlet opening and first, second and third outlet openings;

(d) a valve spindle mounted in said valve housing for movement to establish sequentially an "Off" position, a "Pilot" position, a "Low" position, a "Medium" position and a "High" position;

(e) a first conduit communicating said first outlet opening with said pilot light assembly;

(f) a second conduit communicating said second outlet opening with said first plaque burner;

(g) a third conduit communicating said third outlet opening with said second plaque burner;

(h) said valve spindle having a first exit aperture adapted to be in communication with (i) said first outlet opening as the spindle is moved consecutively between the "Pilot", "Low", "Medium" and "High" positions, and (ii) said third outlet opening when said spindle is in its "Medium" and "High" positions and a position intermediate the "Low" and "Medium" positions;

(i) said valve spindle having a second exit aperture adapted to be in communication with said second outlet opening when said spindle is in its "Low" position and when the spindle is in an intermediate position between its "Low" position and its "Medium" position;

(j) said valve spindle having a third exit aperture adapted to be in communication with said second outlet opening when the spindle is located in its "High" position; and (k) said valve spindle including passageway means communicating said inlet opening with said first, second and third exit apertures thereby to establish gas flow paths between the inlet opening and (i) the pilot light assembly when the spindle is in all of its positions except the "Off" position, (ii) the first plaque burner only when the spindle is in the "Low" position, (iii) the second plaque burner only when the spindle is in its "Medium" position, and (iv) the first and second plaque burners when the spindle is in its "High" position.

2. The apparatus according to claim 1 wherein said spindle is mounted for rotation within the valve body.

3. The apparatus according to claim 2 wherein said spindle is frustoconical in shape and is mounted for rotation about its central axis.

4. The apparatus according to claim 3 wherein said first exit aperture is elongated in the direction of rotation of the spindle and wherein the second and third exit apertures are generally circular in shape.

5. The apparatus according to claim 4 wherein said second exit aperture has a diameter larger than the diameter of said third exit aperture.

6. The apparatus according to claim 4 wherein said first exit aperture is in the form of an arcuate slot and wherein said second and third exit apertures are in the form of respective radial bores.

7. The apparatus according to claim 3 wherein said spindle has a central axial passageway, said first exit aperture being in the form of an arcuate slot communicating with said axial passageway and with the exterior surface of the spindle, said second and third exit apertures being in the form of respective radial bores communicating with said axial passageway and with the exterior surface of the spindle.

8. The apparatus according to claim 7 wherein said bore of the second exit aperture has a diameter larger than the diameter of said bore of the third exit aperture.

* * * * *